US011313010B2

(12) United States Patent
Wang et al.

(10) Patent No.: US 11,313,010 B2
(45) Date of Patent: Apr. 26, 2022

(54) METHOD OF FORMING PARTS FROM SHEET METAL

(71) Applicant: IMPERIAL COLLEGE INNOVATIONS LIMITED, London (GB)

(72) Inventors: Li-Liang Wang, London (GB); Omer Elfakir, London (GB); Yuhao Sun, London (GB); Kang Ji, London (GB); Zhaoheng Cai, London (GB); Xi Luan, London (GB); Xiaochuan Liu, London (GB)

(73) Assignee: IMPERIAL COLLEGE INNOVATIONS LIMITED, Greater London (GB)

( * ) Notice: Subject to any disclaimer, the term of this patent is extended or adjusted under 35 U.S.C. 154(b) by 9 days.

(21) Appl. No.: 16/641,693

(22) PCT Filed: Aug. 23, 2018

(86) PCT No.: PCT/GB2018/052404
§ 371 (c)(1),
(2) Date: Feb. 25, 2020

(87) PCT Pub. No.: WO2019/038556
PCT Pub. Date: Feb. 28, 2019

(65) Prior Publication Data

US 2020/0208236 A1 Jul. 2, 2020

(30) Foreign Application Priority Data

Aug. 25, 2017 (GB) ..... 1713741

(51) Int. Cl.
*C21D 9/46* (2006.01)
*B21D 22/02* (2006.01)
(Continued)

(52) U.S. Cl.
CPC ..... *C21D 9/46* (2013.01); *B21D 22/022* (2013.01); *C21D 1/673* (2013.01); *C21D 8/02* (2013.01); *C21D 2211/008* (2013.01)

(58) Field of Classification Search
None
See application file for complete search history.

(56) References Cited

U.S. PATENT DOCUMENTS

2016/0326619 A1 11/2016 Bassi et al.
2017/0101704 A1 4/2017 Bassi et al.

FOREIGN PATENT DOCUMENTS

CN 106191406 A 12/2016
EP 3279350 A1 * 2/2018 ..... C22F 1/053

OTHER PUBLICATIONS

PCT/GB2018/052404, International Search Report and WrittenOpinion, dated Dec. 4, 2018, 9 pages—English.
(Continued)

*Primary Examiner* — Scott R Kastler
(74) *Attorney, Agent, or Firm* — Andrew F. Young; Nolte Lackenbach Siegel

(57) ABSTRACT

A method of forming a part from sheet metal and a part formed by said method. The method comprising the steps of: (a) heating a metal sheet to a temperature T; and (b) forming the sheet into the part between dies while applying cooling means to the sheet, where in step a) the metal sheet is heated at a rate of at least 50° C.·$s^{-1}$, and temperature T is above a critical forming temperature and does not exceed a critical microstructure change temperature of said metal sheet.

17 Claims, 10 Drawing Sheets

(51) Int. Cl.
*C21D 1/673* (2006.01)
*C21D 8/02* (2006.01)

(56) References Cited

OTHER PUBLICATIONS

Mori K et al: "Warm and Hot Stamping of Ultra High Tensile Strength Steel Sheets Using Resistance Heating", CIRP Annals, vol. 54, No. 1,2005,pp. 209-212, XP029790508,ISSN: 0007-8506, DOI:10.1016/S0007-8506(07)60085-7; the whole document.
CN 2018800699741, Chinese Office Action dated May 31, 2021, 7 pages—English, 9 pages—Chinese.
CN 2018800699741, Chinese 2nd Office Action dated Nov. 17, 2021, 11 pages—English, 6 pages—Chinese.

* cited by examiner

PRIOR ART

PRIOR ART

METHOD OF FORMING PARTS FROM SHEET METAL

CROSS REFERENCE TO RELATED APPLICATIONS

This application relates to, and claims priority from PCT/GB2018/052404 filed Aug. 23, 2018, the entire contents of which are incorporated herein by reference, which in turn claims priority to GB Ser. No.: 1713741.5 filed Aug. 25, 2017

FIGURE SELECTED FOR PUBLICATION

FIG. 3

BACKGROUND OF THE INVENTION

Field of the Invention

The present invention relates to a method of forming parts from metal. In embodiments, the present invention relates to a method for forming parts from metal sheet.

Description of the Related Art

Processes using "warm stamping" (sometimes known as warm forming technologies) are well known for forming parts from metal sheet. Essentially, warm stamping involves heating up a metal blank (sometimes called a workpiece) to an elevated temperature, and forming a part therefrom by way of tools such as a die set; the elevated temperature during processing enhances ductility of the workpiece material and reduces flow stress therein, thus enabling parts of complex shapes to be formed. Conventional warm stamping techniques such as this are known to damage the desired microstructure of the workpiece during processing leading to formed parts with unpredictable characteristics and generally reduced post-form strength. For the aforementioned reasons, warm stamping techniques are generally not used for forming high-strength parts. A typical warm stamping process for a boron steel sheet is shown in FIG. 2 as the dotted line on the graph and in the processing route below.

Processes using "hot stamping" are emerging as preferred solutions for forming high-strength parts from steel sheet for applications in, for example, automotive "body in white" (BiW), and chassis and suspension (C&S) parts. The development of ultra-high-strength steels such as Boron steel makes such "hot stamping" process feasible for the production of automotive safety critical panel parts, such as A-pillars, B-pillars, bumpers, roof rails, rocker rails and floor tunnels for Body-in-White and tubular parts and twist beams for C&S. The global demand for such ultra-high-strength steel parts has been growing sharply in recent years.

A typical hot stamping process for a boron steel sheet is shown in FIG. 1. Essentially it comprises the steps of:

(a) Heating a steel blank to above its austenitisation temperature, say 925° C., and soaking at that temperature to enable all the metal to be transformed into austenite. In this state the metal is soft and has high ductility (easy to form);

(b) Quickly transferring the austenitised material blank to the press;

(c) Forming the blank into the shape of the component using a cold die set, which is normally water cooled;

(d) Holding the formed part within the cold die set for a certain period (typically at least 6-10 seconds depending on geometry, sheet thickness, pressure, etc.) for quenching, enabling the hard phase of the material, e.g. martensite, (for a high-strength component) to be formed; and (e) Releasing the die when the part temperature has dropped to a sufficiently low level, say 250° C., and taking the component out.

Such a process is sometimes referred to as a "hot stamping, cold die forming and quenching" process or as a "hot stamping and press hardening" process.

In this existing hot stamping process for forming complex parts from sheet steel, a sheet work-piece is transferred, as quickly as possible, from a furnace to tools (a die set) at room temperature in which it is deformed and quenched simultaneously. The quench rate is sufficiently rapid to produce a martensitic microstructure in the steel, which form the basis for high strength products. Holding the formed part within the cold die set for a period of time allows the formed part to cool and form a "hard phase" (such as martensite in the case of a boron steel sheet), which results in improved post-form strength and reduced springback. The term "springback" is used herein to describe the extent to which formed parts elastically deform back towards their original sheet shape.

ASPECTS AND SUMMARY OF THE INVENTION

An aspect and feature of the present invention is to provide improvements to existing stamping processes and, in particular, to provide improvements to existing stamping processes for high-strength products.

In general terms, a fast warm heating method is proposed to improve manufacturing productivity of high-strength metal sheet parts. In the proposed fast warm heating method, a metal sheet is heated rapidly to a temperature at which it can be formed. This temperature is below a critical microstructure change temperature, i.e. below a temperature which would cause substantial change to the microstructure of the metal being heated. It has surprisingly been found that rapid heating of the metal sheet prior to forming, within the conditions provided by the present method, avoids any substantial changes to the microstructure of the metal sheet, and surprisingly improves ductility and post-form strength of the formed part when compared to ductility and post-form strength of parts formed using the same metal sheets but using conventional methods. The ductility and post-form strength of parts formed in accordance with the present methods have even more surprisingly been found to provide formed parts with similar ductility and strength properties to those of the metal sheet before it was heated and formed.

Avoiding any substantial changes to the sheet's microstructure means that:

Firstly, initial substantial heating and then rapid cooling from the substantial temperature (known as quenching) in order to form a desired "hard phase" is not required. In this way, the time necessary for heating sufficiently, and then for the dies to be clamped together (allowing the part to form) is reduced, and often substantially reduced;

Secondly, the physical properties of the metal sheet remain substantially unaltered after the part is formed. In this way, the material the formed part is to be made from can be selected based on the properties of the initial phase of the material being used, and not based on the properties of the desired end phase as is necessary in existing hot stamping processes (which may or may not be obtained in a uniform fashion throughout the formed part); and Thirdly, the method can be applied to a variety of types of metals and metal alloys without needing to consider the properties of any resultant metal phases that would result if processed using existing hot stamping methods.

Forming the metal sheet at a lower temperature reduces energy usage in the overall process and therefore reduces cost. Other beneficial effects result from optional features.

According to a first aspect of this invention, there is provided a method of forming a part from sheet metal, the method comprising the steps of: heating a metal sheet to a temperature T; and forming the sheet into the part between dies whilst applying cooling means to the sheet; where in step (a) the metal sheet is heated at a rate of at least 50° C.·$s^{-1}$, and temperature T is above a critical forming temperature for the metal and does not exceed a critical microstructure change temperature of said metal sheet.

Temperature T relates to the temperature above which the metal sheet may be formed (known as the "critical forming temperature"), and below which would cause substantial changes occur to the sheet's microstructure (known as the "critical microstructure change temperature"). In other words, the temperature T must be high enough to enable forming but not so high that substantial changes occur to the microstructure of the metal sheet. The temperature at which microstructure changes occur (such as phase transformations, precipitation or re-crystallization) for a given material and a given heating rate can be found in the literature or determined experimentally using known techniques.

The critical microstructure change temperature as described herein is a temperature below which no substantial changes are made to the microstructure of the metal sheet. Changes in microstructure as discussed herein may relate to changes such as phase transformations (e.g. austenitisation in the case of steel), precipitation and/or re-crystallization. Heating the metal sheet in step (a) to a temperature below the critical microstructure change temperature means that changes to the microstructure of the sheet are substantially avoided, and preferably avoided altogether.

Suppressing all changes to the microstructure in the present method at the claimed heating rate has been found to provide a stamping method with all the benefits described above. It has been found that improvements are still obtained in manufacturing productivity when small changes are made to microstructure of the metal sheet during the proposed method (i.e. where changes are substantially avoided). Substantially avoiding changes in this way may relate to a 1 to 10% change in the microstructure of the metal sheet, preferably a 1 to 5% change, and most preferably a 1 to 3% change. For example, the change in microstructure of the metal sheet may be changes to a degree of 1%, 2%, 3%, 4%, 5%, 6%, 7%, 8%, 9%, or 10%.

Changes in microstructure for a given material can be determined by inspecting a metal sheet's microstructure before and after forming using X-Ray Diffraction (XRD) analysis, Electron Back-Scattered Diffraction (EBSD), Scanning Electron Microscopy (SEM), Transmission Electron Microscopy (TEM) or any other methods known for determine material microstructures. The effect of temperature treatment on microstructure in different metal sheets can be reviewed using the aforementioned analysis techniques to determine the critical microstructure change with temperature. The changes may include the generation of new phases and/or precipitates; the dissolution of phases and/or precipitates and/or recrystallized grains etc., all of which can be qualified by the changes in volume fraction, i.e. the total volume of changed microstructural features in a unit volume.

Preferably, the temperature T does not exceed a temperature which would cause any microstructure changes to the metal sheet in the form of phase transformations, re-crystallization, and/or precipitation.

The critical forming temperature for a given material may be determined by comparing the known elongations the metal sheet will be subjected to when forming a component with tensile test data (such as data obtained from uniaxial tension tests) for the given material under different deformation temperatures; the critical forming temperature is the minimum temperature the metal sheet must be to allow the desired elongations to be applied to the metal sheet (during forming) without failure. Tensile test data for given materials can be obtained using a tensile test apparatus such as a Gleeble® 3800 thermo-mechanical simulator. Other known methods may be used to determine critical forming temperatures.

After step (a) the heated metal sheet may be transferred to a location between the dies for forming. Alternatively, the metal sheet may be heated between the dies, thereby not requiring transferral after heating and before forming. When the metal sheet is transferred, the heated metal sheet should be transferred in such a way and at such a speed so as to not allow the temperature of the heated sheet to fall below the critical forming temperature. In this way, the temperature T may be considered as a "target temperature" which accounts for any drop in temperature that may result during the time between the end of heating and the start of the forming, and ensures the metal sheet is on or above the critical forming temperature at the time of forming. Allowing the temperature of the heated sheet to fall below the critical forming temperature prior to forming may have a detrimental effect on post-form strength of the formed part.

Where a small amount of change in microstructure occurs during the heating step (a) as described above, it has been found that applying cooling during the forming process advantageously reduces springback of the formed part, increases the productivity of the process as the formed part is cooled to a temperature in which it can be handled and removed from the die set sooner, and maintains post-form strength of the formed product.

In preferred cases where no changes occur to the microstructure of the metal sheet during step (a), it has advantageously been found that a cooling step whilst the sheet is being formed is not required. In this way, it is not necessary to apply any heating or cooling during the forming process when the sheet is between closed dies (after initial heating has been carried out). Thus, a second aspect of this invention relates to a method of forming a part from sheet metal, the method comprising the steps of: heating a metal sheet to a temperature T; and forming the sheet into the part between dies; where in step a) the metal sheet is heated at a rate of at least 50° C.·$s^{-1}$, and temperature T is above a critical forming temperature and does not exceed a temperature which would cause changes to the microstructure of said metal sheet.

The sheet metal may be aluminum, magnesium, titanium, or alloys thereof. Alternatively, the sheet metal may be steel, or alloys thereof such as ultra-high strength steel (UHSS) (for example, steel-boron alloy, martensitic steel or spring steel).

For example, in accordance with the first aspect the proposed method may relate to forming a part from sheet steel, the method comprising the steps of: heating a steel sheet to a temperature T; and forming the sheet into the part between dies whilst applying cooling means to the sheet; where in step a) the steel sheet is heated at a rate of at least 50° C.·s$^{-1}$, and temperature T is above a critical forming temperature and does not exceed a critical microstructure change temperature of said steel sheet.

Preferably, the temperature T does not exceed a temperature which would cause microstructure changes to the steel sheet in the form of phase transformations, re-crystallization, dissolution and/or precipitation. Preferably, the temperature T does not exceed a temperature which would cause austenitisation.

The following optional features may be applied to any of the aspects described above:

In step a) the metal sheet may be heated at a rate of from 50° C.·s$^{-1}$ to 300° C.·s$^{-1}$. Temperature T may be from 50 to 600° C., 200 to 600° C., 300 to 600° C., 300 to 550° C., or 350 to 450° C.

In step (a) the metal sheet may be heated to temperature T using a contact heater, infra-red heater, induction heater or a resistance heater. Preferably, the metal sheet is heated to temperature T using a contact heater.

A contact heater essentially uses two hot platens either side of the metal sheet to apply heat; the temperature of the metal sheet is determined by the temperatures and contact times of the hot platens, and the contact pressure applied thereby. Resistance heaters utilize current density to increase the temperature of the metal sheet. It has been found that irregular shaped metal sheets heated by a resistance heater can encounter uneven heat distribution due to a non-uniform distribution of current density within the metal sheet. Uneven heat distribution during warm or hot stamping processes can lead to reduced post-form strength due to non-uniform changes in material microstructure. Contact heaters do not encounter the same problems as resistance heaters, and can be used advantageously to apply a uniform distribution of heat to any shape of metal sheet. For the aforementioned reasons, the use of a contact heater is preferred.

The cooling means may be configured to cool (which may alternatively be referred to as "quench" or "quenching") the metal sheet to between 100 to 300° C., preferably 125 to 250° C., and more preferably 150 to 200° C. The cooling means may be configured to cool the metal sheet at a rate of at least 10° C.·s$^{-1}$, preferably 10° C.·s$^{-1}$ to 300° C.·s$^{-1}$, and more preferably 50° C.·s$^{-1}$ to 200° C.·s$^{-1}$.

In step (b) of the method, the cooling means may additionally be applied after forming, whilst the sheet is between the dies.

If cooling means are applied after forming whilst the sheet is still between the dies, the cooling occurring during forming may be referred to as the first stage cooling, and the cooling after forming may be referred to as second stage cooling. The first stage cooling occurs whilst the die set is initially forming a part and may account for between 10 to 20% of the cooling applied to the sheet. The second stage cooling occurs after forming but whilst the part is still between the closed die set, and may account for between 80 to 90% of the cooling applied to the sheet. For example, if the sheet is to be cooled from a temperature T of 400° C. to a final temperature of 200° C., the first stage cooling may reduce the temperature of the sheet to between 380° C. to 360° C. (i.e. between 10 and 20%) and then the second stage will finally reduce the temperature to 200° C. (i.e. between 80 to 90%).

Further cooling may optionally be used by the cooling means or additional cooling means in the proposed method either in the die or once the part has been removed from the die where, for example, downstream processing requires the formed part to be at a certain temperature and/or to ensure that no accidental changes are made to the microstructure as a result of mechanical stresses and strains being exerted on the formed part during removal from the dies at an elevated temperature. However, such further cooling is not essential.

The dies may be closed with a force within a required critical contact pressure range. In other words, the dies may be closed with a force which enables the die set to apply a contact pressure to the part being formed, said contact pressure being within a required critical contact pressure range.

The term "contact pressure" as used herein describes the pressure applied by the die set to the metal sheet during the forming process (when the sheet is pressed between the closed die set). Insufficient contact pressure is known to negatively affect post-form strength due to reduced heat transfer efficiency between the die set and the sheet being formed, due to reduced surface contact between the sheet and the die set. Inconsistent contact between the sheet and the die set can result in a formed part with non-uniform properties, due to the non-uniform heat treatment received during the forming process.

In some cases, applying an excessive pressure to the die set during forming can mean that the sheet being formed is not drawn (or formed) into the full extent of the die it lies between (i.e. the die set does not fully close on either side of the sheet being formed), which can in turn result in details such as vertical walls or sharp corners being insufficiently formed to the shape of the die. Excessive contact pressure should be avoided particularly in cases where the contact pressure is applied by blank holders in the die set; blank holders hold the metal sheet against the die during the forming process, and control the flow of material into the die during forming. If the contact pressure applied is too high, flow of the material into the die is restricted and hence drawability is reduced.

To avoid the aforementioned problems with forming processes, a critical contact pressure is applied to the die set to ensure good heat transfer rate between the sheet being formed and the die set, and good drawability of the sheet into the die set (i.e. to ensure the sheet fully conforms to the shape of the die set). The critical contact pressure is dependent on the material is use, surface roughness and any lubricants being used in the process.

Preferably, the closing force is between 15 MPa to 300 MPa, more preferably between the range of 15 MPa to 200 MPa, and even more preferably between the range of 15 MPa to 150 MPa. If additional cooling means are applied after forming in step (b), the dies may be closed with a force of between 20 to 50 MPa when the part is being formed, and with a force of 50 MPa to 200 MPa after forming, whilst the sheet is between the dies. Preferably, if additional cooling means are applied after forming in step (b), the dies may be closed with a force of between 20 to 30 MPa when the part is being formed, and with a force of between 30 MPa to 150 MPa after forming, whilst the sheet is between the dies.

Step (a) and step (b) may advantageously be carried out in a time between 2 to 60 seconds, preferably 2 to 30 seconds, more preferably 2 to 15 seconds, and most preferably less than 10 seconds.

If additional cooling means are applied after forming in step (b), the forming step may be carried out in a time between 1 to 3 seconds and the cooling step after forming whilst the sheet is between the dies is carried out in a time between 1 and 4 seconds; preferably, the forming step may be carried out in a time between 1 to 2 seconds and the cooling step after forming whilst the sheet is between the dies is carried out in a time between 1 and 3 seconds.

A further aspect of the present invention relates to a formed part formed using the methods of the invention.

The present invention may be carried out in various ways and a preferred method in accordance with the invention will now be described by way of example with reference to the accompanying figures, in which:

The above and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
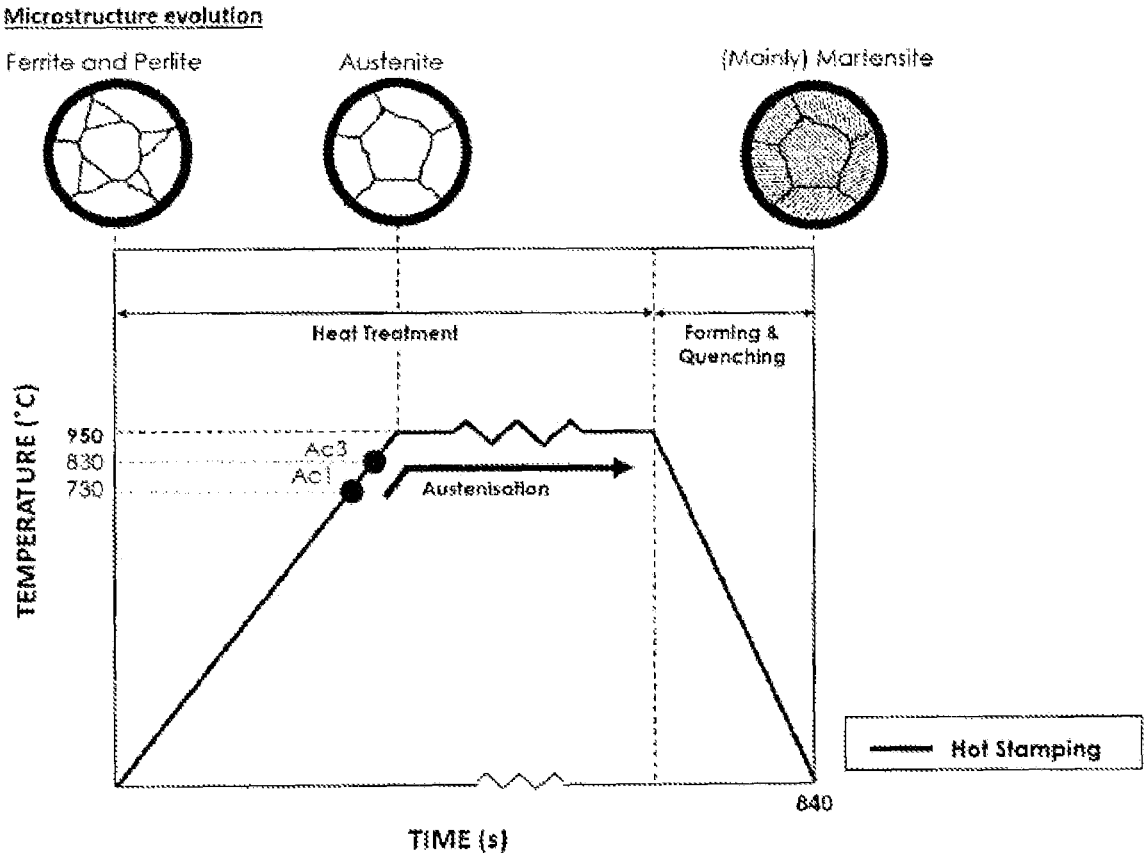
FIG. 1 provides a schematic of an existing hot stamping method.

Reference will now be made in detail to embodiments of the invention. Wherever possible, same or similar reference numerals are used in the drawings and the description to refer to the same or like parts or steps. The drawings are in simplified form and are not to precise scale. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Various operations may be described as multiple discrete operations in turn, in a manner that may be helpful in understanding embodiments of the present invention; however, the order of description should not be construed to imply that these operations are order dependent.

Figure 2:
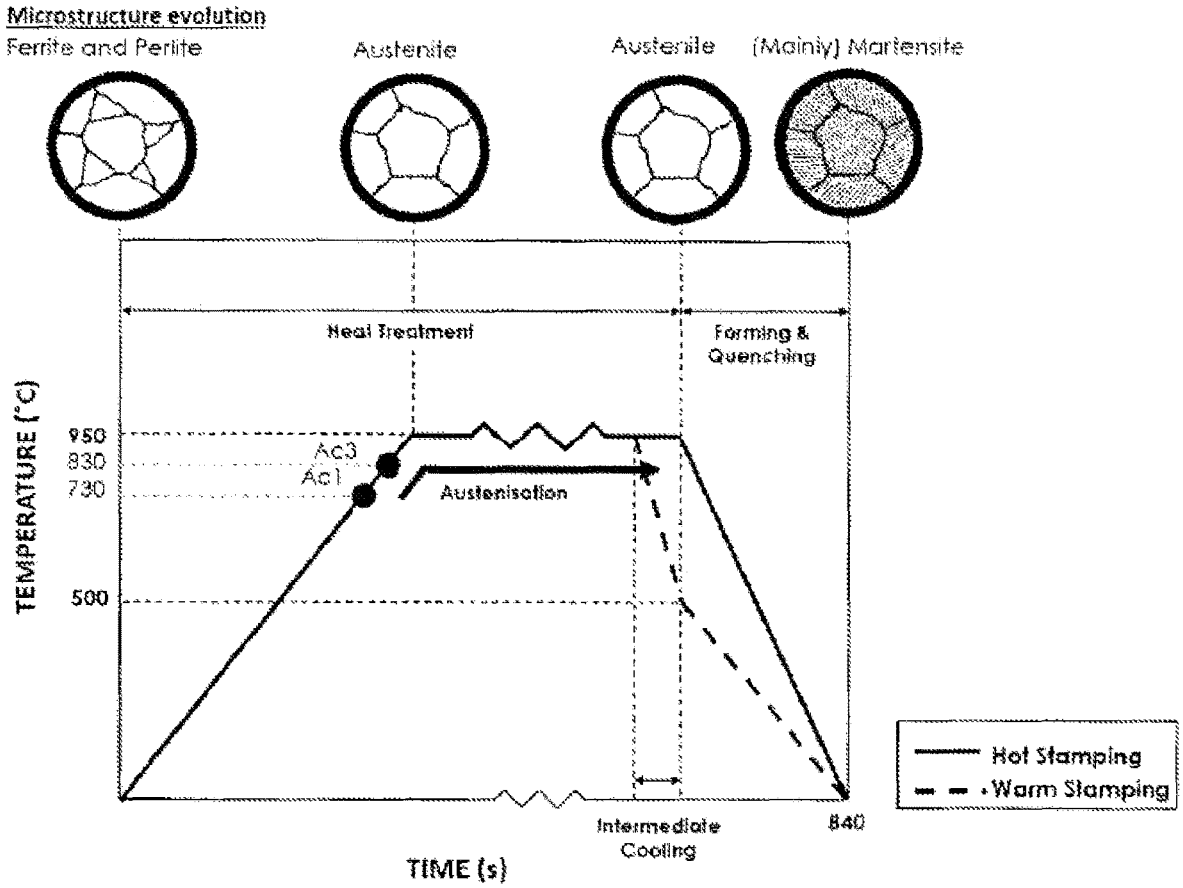
FIG. 2 provides a schematic of an existing warm stamping method, with comparisons drawn to existing hot stamping method.

As described above, existing hot-stamping and warm-stamping methods are shown schematically in FIGS. 1 and 2 respectively. A very important aspect of existing methods for forming high strength steel is that, before a part is formed, the steel sheet to be formed is heat treated at temperatures sufficiently high, e.g. more than 900° C., for a prolonged period of time (known as soaking time) to enable austenitisation to occur, thereby prompting a phase change to a softer phase of the material (austenite). This aspect of the existing methods is energy intensive, and is known to take approximately 75% of the overall processing time to form the finished formed part.

Another very important aspect of existing methods is that, as the hot stamped part is held in cold dies, the cooling rate should be sufficiently high, e.g. more than 25° C.$\cdot s^{-1}$ on average, to enable the hardest phase of the material (for example martensite in cases where steel sheets are used) to be formed. In this way, high strength components can be made. Although a critical aspect of existing methods, cooling the hot stamped part until the hardest phase has formed is time consuming.

The method in accordance with this invention provides a faster stamping method by rapidly heating the metal sheet to be formed to a temperature which is below that which would cause changes to the microstructure of said metal sheet. Such rapid heating has been found to have a surprisingly positive effect on ductility and the post-form strength of the finished formed part (as discussed in more detail below), whilst avoiding any changes to the material's microstructure has been found to reduce energy consumption and overall process time due to avoiding the need for any energy intensive and time consuming heating and cooling steps.

The method in accordance with this invention may be applied to sheets of different metals as defined above. An example of the method in accordance with this invention will now be given where the metal sheet is high strength steel.

The new method involves the following steps:

First, a high strength steel sheet (which also may be referred to as a "blank") is selected and prepared. The preparation of the blank may involve cutting the blank to size when in a cold state and may be followed by ensuring that the initial phase of the high strength steel corresponds to the phase desired after forming. If the initial phase of the high strength steel (before forming) does not correspond to the phase desired in the formed part, then pre-forming treatments can be applied (e.g. heat treatments) before the fast warm stamping method is used.

Secondly, the blank is heated to a temperature T, e.g. between 350-450° C., which is above the critical forming temperature and below the austenitisation temperature of the high strength steel. The heat is applied using a contact heater, which comprises two hot platens which press against the blank from opposing sides, which applies heat at a rate of between 50 to 150° C.$\cdot s^{-1}$. The exact heating rate and critical forming temperature will vary depending on geometric configuration of the formed part and the material of the sheet being formed.

The heating rate in fast warm stamping may be determined by using a thermo-mechanical simulator such as a Gleeble® 3800 to inspect a metal sheet to be formed to find the minimum required heating rate that maintains the material's microstructure when heated to temperature T and provides a required post-form strength. The cooling rate applied by the cooling means is determined by using a thermo-mechanical simulator such as a Gleeble® 3800 to find the minimum required cooling rate that maintains the material's microstructure. The heating rate is determined when the microstructure of the test-piece does not change remarkably. The critical forming temperature may be determined experimentally using the method discussed above, where ductility is considered as a function of temperature to determine minimum ductility required to form the part.

Thirdly, the warm blank is transferred from the contact heater to a cold die set comprising cold forming tools within a pre-determined period of time to ensure that the temperature of the blank does not fall below the critical forming temperature of the high strength steel. This third step is optional, and may not be required if, for example, the blank is heated in the die set.

Fourthly, once the blank is transferred to the die set comprising cold forming tools (which also may be referred to as a "press") the blank is formed and cooled. The forming process shapes the blank to the desired shape by holding the blank between dies whilst cooling is applied simultaneously to provide initial first stage cooling to the blank. The forming process uses the dies to apply a fast forming pressure of up to approximately 30 MPa and for approximately 1 or 2 seconds. The initial first stage cooling cools the blank to approximately 10 to 20% towards a final target temperature of approximately 100 to 300° C. After forming, the pressure applied to the dies (and therefore the pressure applied to the formed part) may be changed to more than 30 MPa but below 140 MPa, and cooling is maintained to cool the blank to the final target temperature of between 100 to 300° C. (as mentioned above, cooling may not be required if no changes are made to the microstructure of the metal sheet during heating). The entire forming and cooling (quenching) time during this fourth step is approximately 1 to 4 seconds. As mentioned above, the provision of further cooling once the formed part is removed from the die set is optional.

After the stamping and quenching process is complete, the formed part may be removed from the press for immediate use or for further processing. If the formed part is made from aluminum or alloys thereof, the formed part may be removed from the press before the part is cooled to room temperature and moved to an incubation chamber for further processing where residual heat left in the formed part is used to shorten the artificial aging process.

Figure 4:
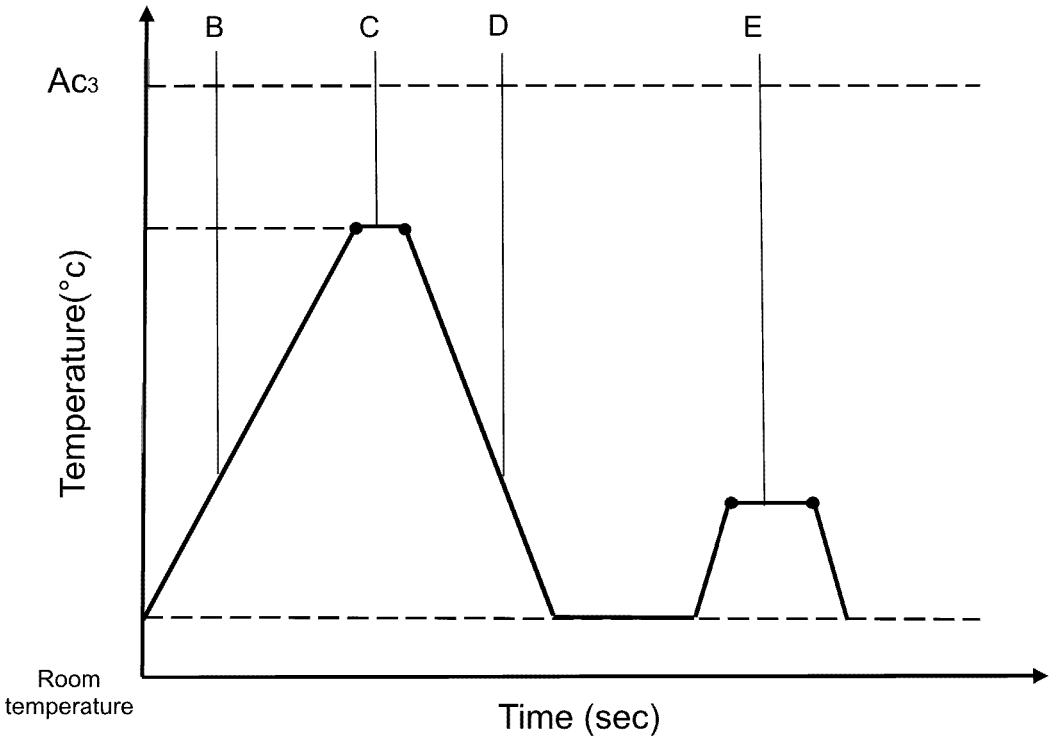
FIG. 4 provides a temperature profile for a method in accordance with the invention.

FIG. 4 shows a temperature profile of a blank undergoing the fast-warm stamping process described above. Referring to FIG. 4, B represents the fast heating step, C represents the transfer period, D represents the stamping and quenching period, and E represents an incubation period. Ac3 shown on FIG. 4 represents the austenitisation temperature of the high strength steel. The transfer period D of the temperature profile shown in FIG. 4 does not show any reduction in temperature, however, in some cases there may be a temperature drop from where the blank is removed from the heater to when the forming begins.

Figure 3:
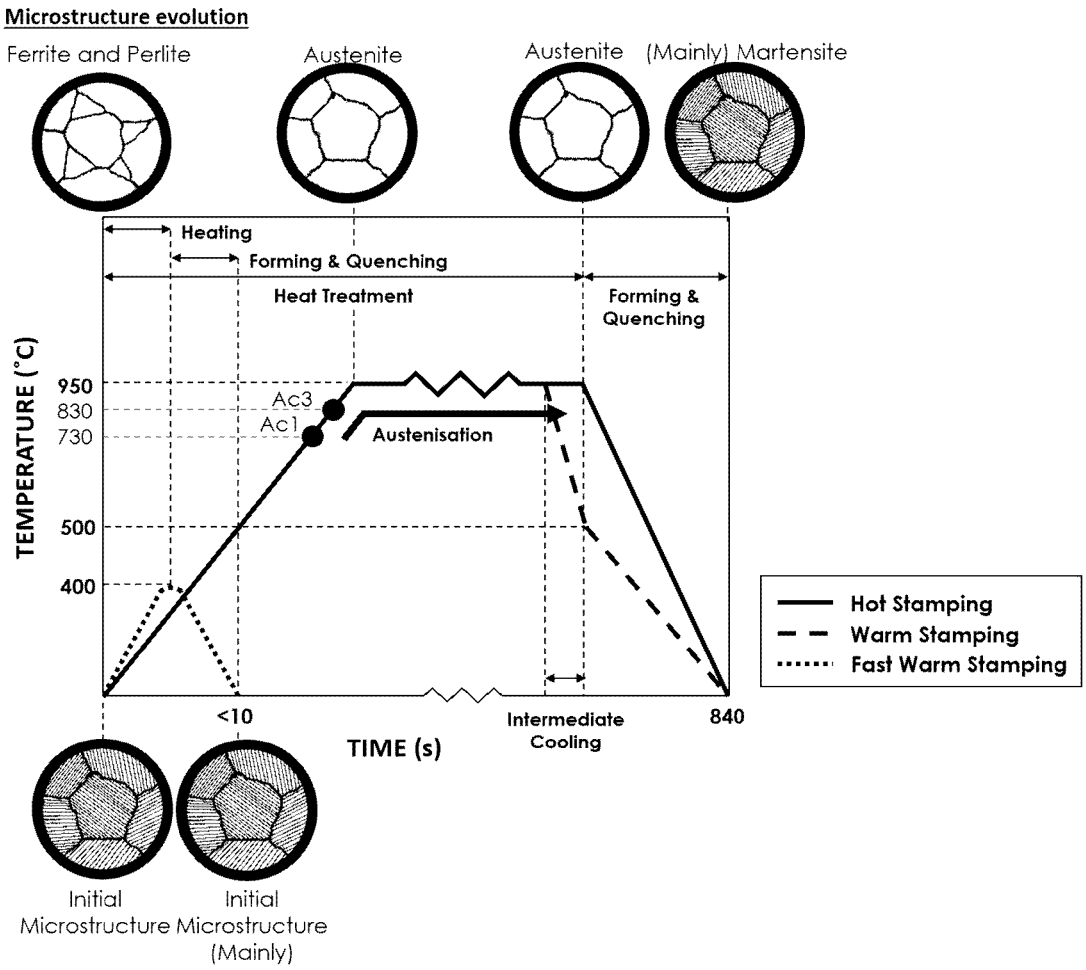
FIG. 3 provides a schematic of a fast warm-stamping method in accordance with the invention, with comparisons drawn to existing hot and warm stamping methods.

It has been found that by using a fast-warm stamping method in accordance with the present invention, the total time taken from heating a blank to removing a formed part from a press (known as a "cycle time") is less than 10 seconds (as shown on FIG. 3), compared to existing hot-stamping and warm-stamping processes which have cycle times in excess of 10 minutes, as shown in FIGS. 2 and 3 where total cycle time is 840 seconds.

FIGS. 5 to 8 show data obtained from formed parts produced by the method in accordance with the present invention using a high strength steel sheet.

Figure 5:
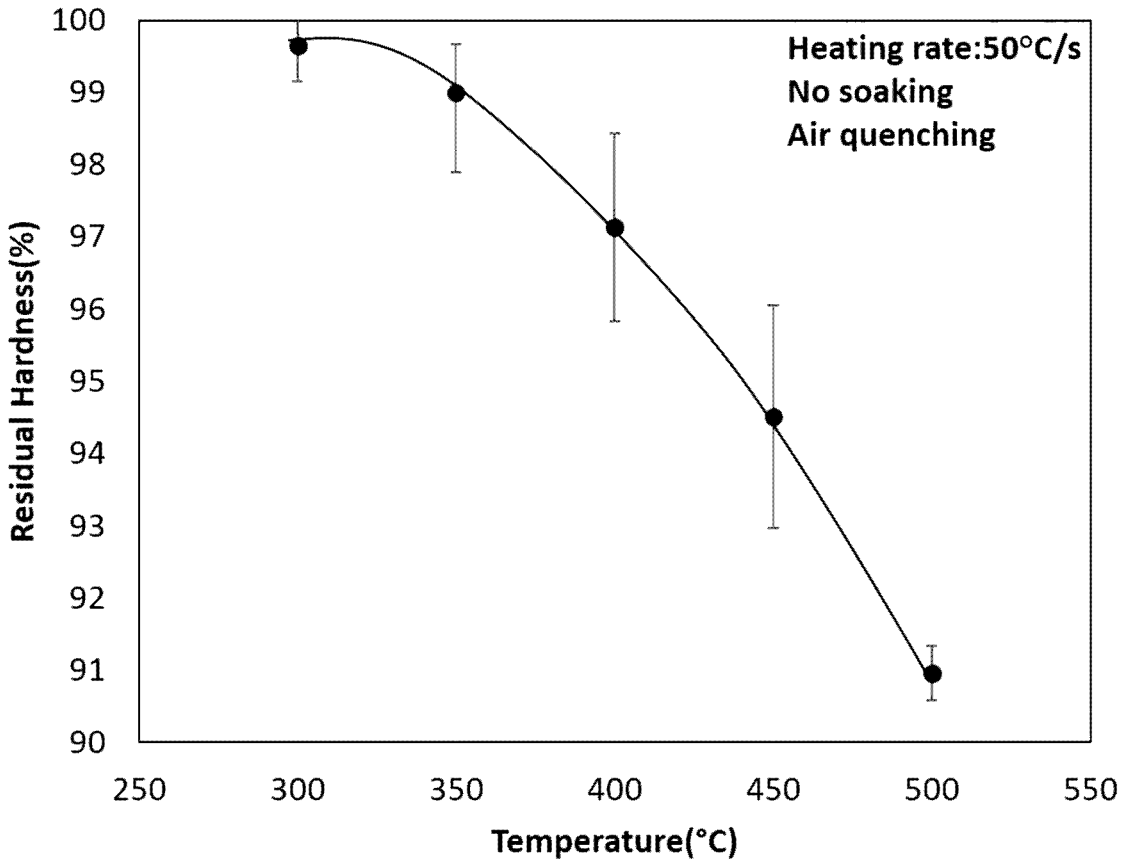
FIG. 5 provides a residual hardness profile as a function of temperature T for a formed martensitic steel part made by a method in accordance with the invention.

FIG. 5 shows uniaxial tensile test results where residual hardness (in terms of percentage of hardness of the high strength steel prior to forming) is shown as a function of temperature T with a heating rate of 50° C.·$s^{-1}$ and with no soaking time. Forced air cooling was applied during the forming to cool the formed part to below 200° C.

Figure 6:
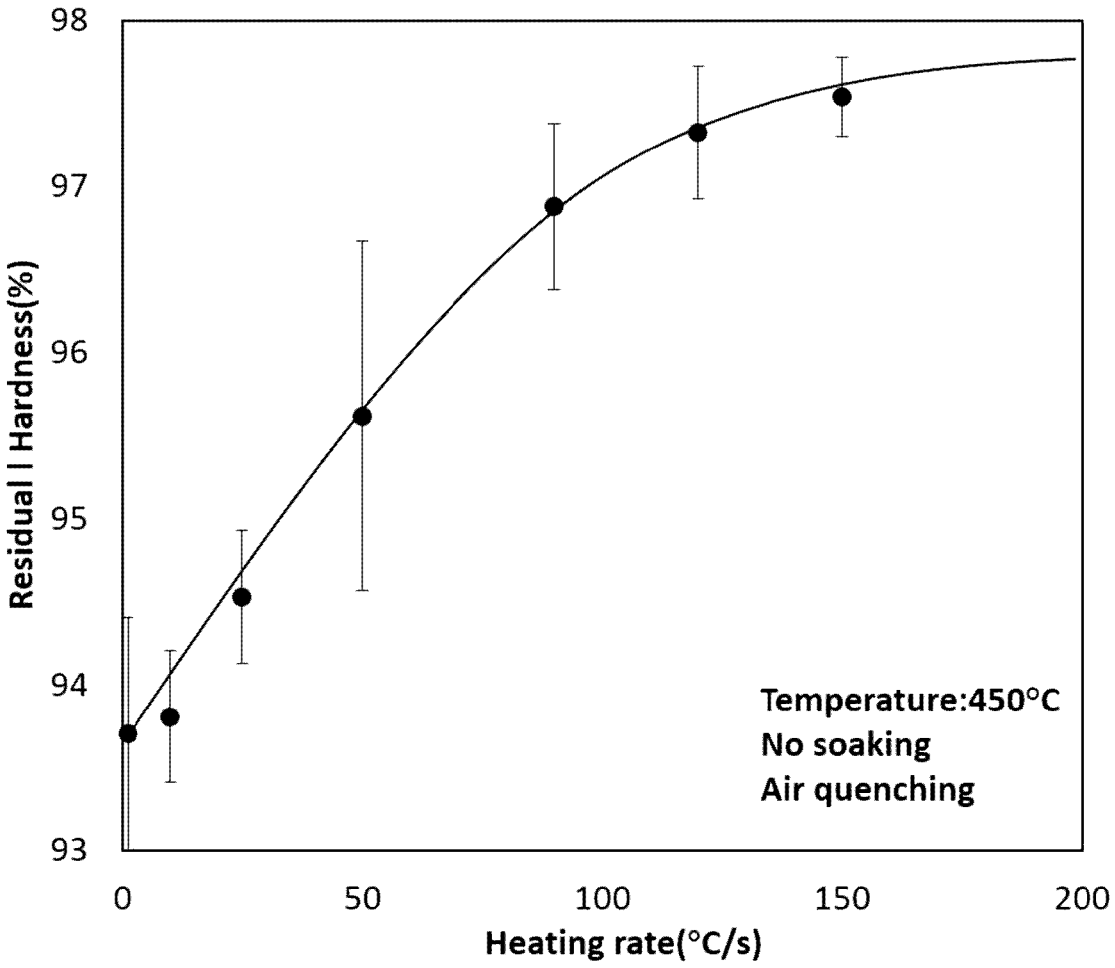
FIG. 6 provides a residual hardness profile as a function of heating rate for a formed martensitic steel part made by a method in accordance with the invention.

FIG. 6 shows residual hardness (in terms of percentage of hardness of the high strength steel prior to forming) varying as a function of heating rate, with temperature T as 450° C. and with no soaking time or cooling of the formed part.

Figure 7:
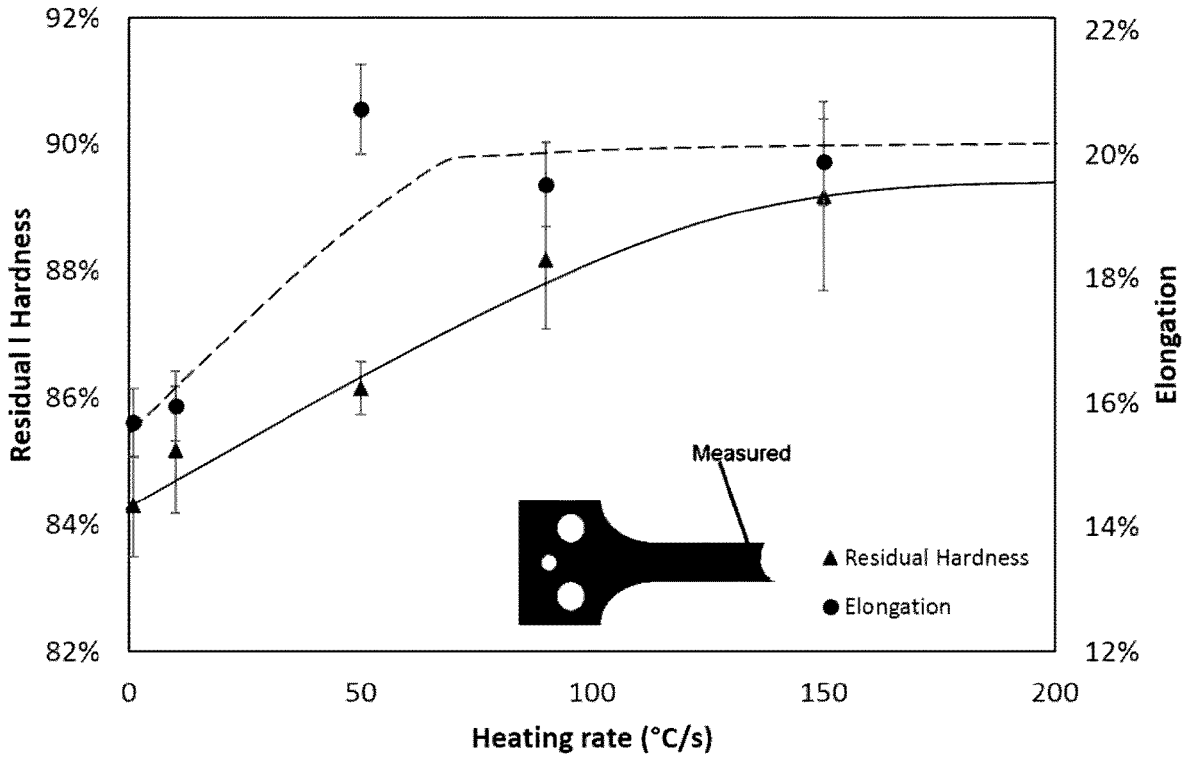
FIG. 7 provides a residual hardness and elongation profiles as a function of heating rate for a formed martensitic steel part made by a method in accordance with the invention.

FIG. 7 shows residual hardness (in terms of percentage of hardness of the high strength steel prior to forming) and percentage elongation (ductility), both varying as a function of heating rate, with temperature T as 450° C. and with no soaking time. Forced air cooling was applied to cool the high strength steel to below 200° C. FIG. 7 shows improved post-form ductility and strength with increasing heating rate.

Figure 8:
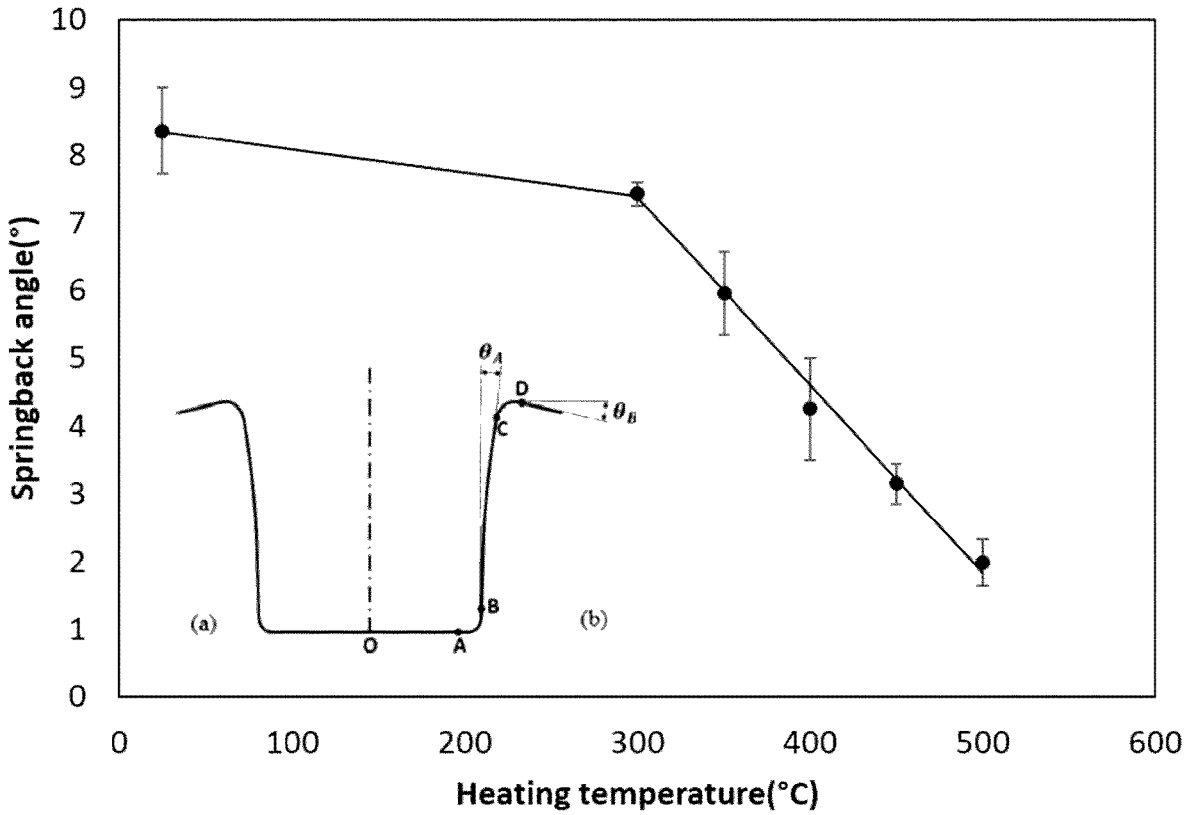
FIG. 8 provides a springback profile as a function of temperature T for a U-shaped part formed by a method in accordance with one aspect of the invention.

FIG. 8 shows springback exhibited by a beam formed in a U-shape at a function of temperature T.

Figure 9:
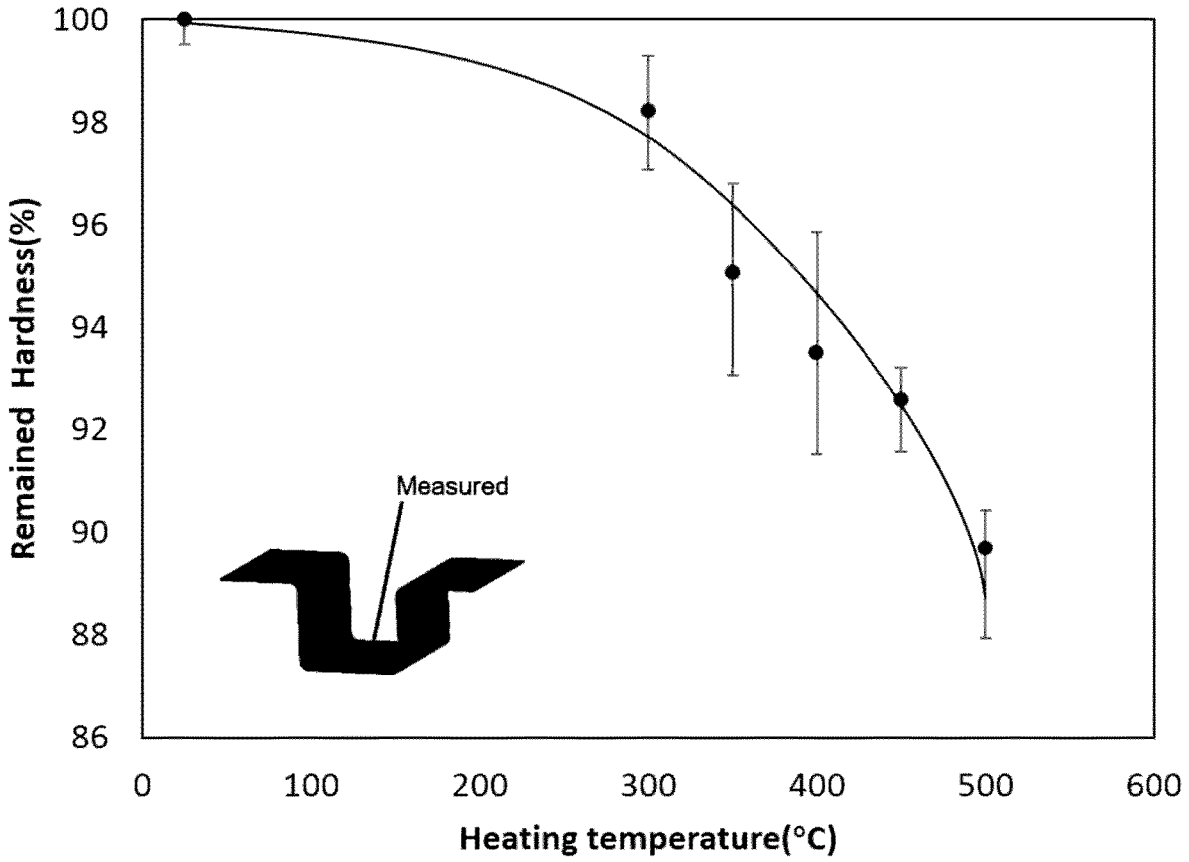
FIG. 9 provides a residual hardness profile as a function of temperature T for a U-shaped formed martensitic steel part formed by a method in accordance with the invention.

FIG. 9 shows post-form strength in a U-shape component formed by using fast warm stamping in accordance with the present invention, conducted at different temperatures T.

Figure 10:
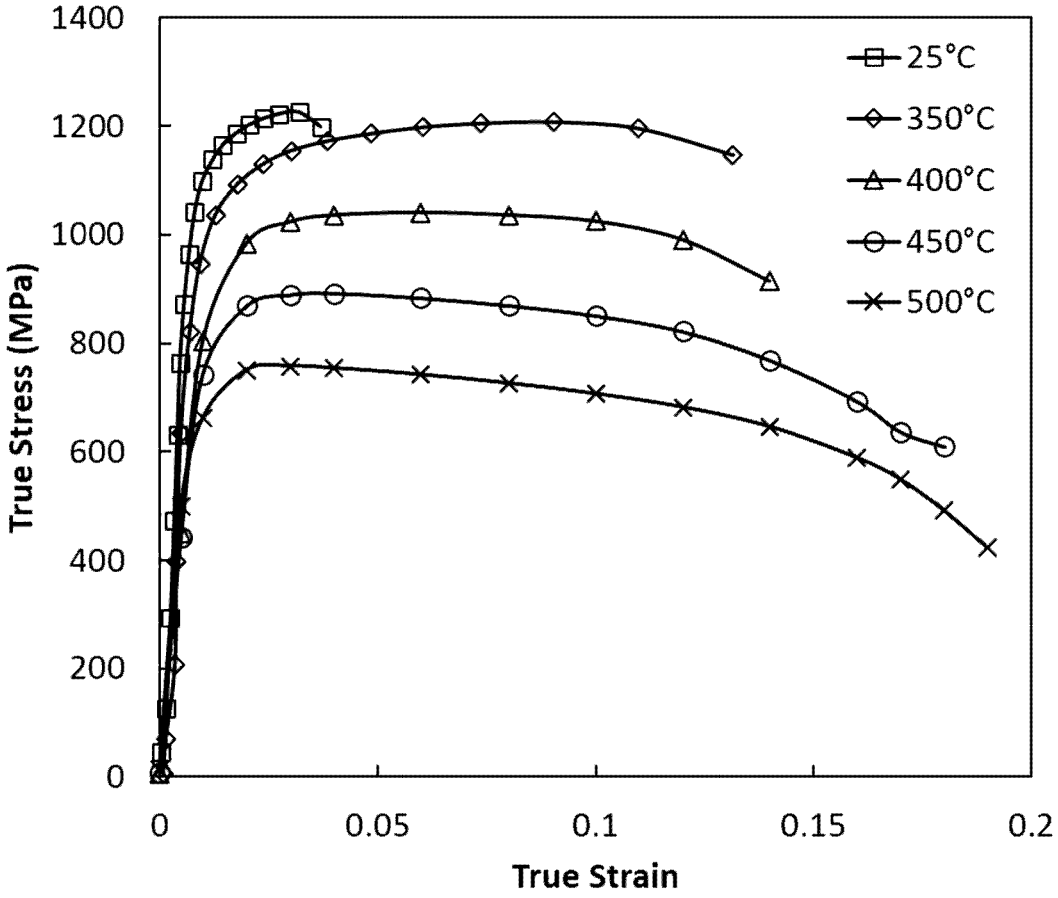
FIG. 10 provides the effects of temperature T on stress-strain relationship for a martensitic steel part formed by a method in accordance with the invention.

FIG. 10 shows uniaxial tensile test results of a UHSS conducted at fast warm stamping conditions, in accordance with the present invention.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

The invention claimed is:

1. A method of forming a part from a metal sheet, the method comprising the steps of:

heating said metal sheet to a temperature T at a rate from 50° C.·$s^{-1}$ to 300° C.·$s^{-1}$;

said temperature T being above a critical forming temperature and does not exceed a critical microstructure change temperature of said metal sheet;

providing a cooling means for cooling said metal sheet; and forming in a first forming step the metal sheet into the part between at least one of a plurality of dies while simultaneously applying said cooling means to the metal sheet in a first cooling step at a rate of at least from 10° C.·$s^{-1}$ to 300° C.·$s^{-1}$.

2. The method of claim 1, wherein:

said cooling means conducts said first cooling step between 100 to 300° C.

3. The method of claim 1, wherein:

said temperature T is from 50 to 600° C.

4. The method of claim 3, wherein:

said heating to said temperature T is conducted by at least one of a contact heater, an infra-red heater, an induction heater, and a resistance-heater.

5. The method of claim 4, wherein:

said step of forming in said first forming step further comprises a step of:

closing said plurality of dies with a force within a critical contact pressure range.

6. The method of claim 5, wherein:

said force in said critical contact pressure range is between 15 MPa to 300 MPa.

7. The method of claim 6, wherein:

said step of forming further comprises a second step of post-forming where said metal sheet is held between said plurality of dies;

said first forming step is conducted with said force between 20 MPa to 50 MPa; and said second step of post-forming is conducted with said force between 50 MPa to 150 MPa.

8. The method of claim 1, wherein:

said first cooling step applied during said first forming step is between 10%-20% of a total cooling applied to said metal sheet;

conducting a second cooling step of said metal sheet after said first forming step while said metal sheet is between said plurality of dies; and said second cooling step being an in-die quenching and being 80% to 90% of said total cooling applied to said metal sheet.

9. The method of claim 1, wherein:

said heating and forming occurs in from 2 to 60 seconds.

10. The method of claim 8, wherein:

said forming occurs in from 1 to 3 seconds and said second cooling step occurs in from 1 to 4 seconds.

11. The method of claim 1, wherein:

the metal sheet is a material selected from a group consisting of: aluminum, magnesium, titanium, an alloy of aluminum, an alloy of magnesium, and an alloy of titanium.

12. The method of claim 1, wherein:

said metal sheet is an alloy of iron;

said alloy of iron is steel;

said steel is an ultra-high strength steel (UHSS); and said ultra-high strength steel (UHSS) is a martensitic steel.

13. A formed part product formed according to the method of claim 1.

14. A method of forming a part from a metal sheet, the method comprising the steps of:

heating said metal sheet to a temperature T at a rate from 50° C.·s$^{-1}$ to 300° C.·s$^{-1}$;

said temperature T being above a critical forming temperature and does not exceed a temperature which would cause changes to the microstructure of said metal sheet; and forming in a forming step the metal sheet into the part between at least one of a plurality of dies.

15. A method of forming a part from a metal sheet, the method comprising the steps of:

Heating said metal sheet to a temperature T at a rate from 50° C.·s$^{-1}$ to 300° C.·s$^{-1}$;

said temperature T being above a critical forming temperature and does not exceed a critical micro-structure change temperature of said metal sheet;

providing a cooling means for cooling said metal sheet; and forming in a first forming step the metal sheet into the part between at least one of a plurality of dies while simultaneously applying said cooling means to the metal sheet in a first cooling step at a rate of at least from 10° C.·s$^{-1}$ to 300° C.·s$^{-1}$;

said temperature T is from 50 to 600° C.;

said heating to said temperature T is conducted by at least one of a contact heater, an infra-red heater, an induction heater, and a resistance-heater;

said step of forming in said first forming step further comprises a step of:

closing said plurality of dies with a force within a critical contact pressure range;

said force in said critical contact pressure range is between 15 MPa to 300 MPa;

said step of forming further comprises a second step of post-forming where said metal sheet is held between said plurality of dies;

said first forming step is conducted with said force between 20 MPa to 50 MPa; and said second step of post-forming is conducted with said force between 50 MPa to 150 MPa.

16. A method of forming a part from a metal sheet, the method comprising the steps of:

heating said metal sheet to a temperature T at a rate from 50° C.·s$^{-1}$ to 300° C.·s$^{-1}$;

said temperature T being above a critical forming temperature and does not exceed a critical micro-structure change temperature of said metal sheet;

providing a cooling means for cooling said metal sheet;

forming in a first forming step the metal sheet into the part between at least one of a plurality of dies while simultaneously applying said cooling means to the metal sheet in a first cooling step at a rate of at least from 10° C.·s$^{-1}$ to 300° C.·s$^{-1}$;

said first cooling step applied during said first forming step is between 10%-20% of a total cooling applied to said metal sheet;

conducting a second cooling step of said metal sheet after said first forming step while said metal sheet is between said plurality of dies; and said second cooling step being an in-die quenching and being 80% to 90% of said total cooling applied to said metal sheet.

17. The method of claim 16 wherein:

said forming occurs in from 1 to 3 seconds and said second cooling step occurs in from 1 to 4 seconds.

* * * * *